US008104441B2

(12) United States Patent
Moeck et al.

(10) Patent No.: US 8,104,441 B2
(45) Date of Patent: Jan. 31, 2012

(54) CAM FOLLOWER FOR A VALVE DRIVE OF AN INTERNAL COMBUSTION ENGINE

(75) Inventors: Stephan Moeck, Pretzfeld (DE); Michael Kress, Lonnerstadt (DE)

(73) Assignee: Schaeffler KG, Herzogenaurach (DE)

( * ) Notice: Subject to any disclaimer, the term of this patent is extended or adjusted under 35 U.S.C. 154(b) by 371 days.

(21) Appl. No.: 12/509,198

(22) Filed: Jul. 24, 2009

(65) Prior Publication Data

US 2010/0018485 A1 Jan. 28, 2010

(30) Foreign Application Priority Data

Jul. 25, 2008 (DE) ..... 10 2008 034 648

(51) Int. Cl.
*F01L 1/18* (2006.01)

(52) U.S. Cl. ..... 123/90.39; 29/888.2; 74/559; 74/569

(58) Field of Classification Search ..... 123/90.39, 123/90.44; 29/888.2; 74/559, 567, 569
See application file for complete search history.

(56) References Cited

U.S. PATENT DOCUMENTS 6,889,644 B2 * 5/2005 Ferracin et al. ..... 123/90.39

* cited by examiner

*Primary Examiner* — Ching Chang
(74) *Attorney, Agent, or Firm* — Lucas & Mercanti, LLP

(57) ABSTRACT

A cam follower for a valve drive of an internal combustion engine. The cam follower has a housing and a cam roller. The cam roller is arranged between the side walls of the housing and is mounted on a journal which bridges the side walls. The cam roller, which has an outer ring, a rolling body set and an inner ring, is a combined plain and rolling bearing. The outer ring and the inner ring are in sliding contact with one another, and the rolling body set is arranged between the inner ring and the journal.

4 Claims, 2 Drawing Sheets

CAM FOLLOWER FOR A VALVE DRIVE OF AN INTERNAL COMBUSTION ENGINE

This application claims the priority of DE 10 2008 034 648.9 filed Jul. 25, 2008, which is incorporated by reference herein.

FIELD OF THE INVENTION

The invention relates to a cam follower for a valve drive of an internal combustion engine. The cam follower comprises a housing and a cam roller which is held at its end surfaces between side walls of the housing, with the side walls having run-on surfaces for the end surfaces of the cam roller.

BACKGROUND OF THE INVENTION

Cam followers of said type are known as valve drive elements which tap the stroke of a cam of a camshaft in a low-friction manner by means of a cam roller and transmit said stroke to a gas exchange valve. Said cam followers may be embodied either as linearly guided roller tappets or as pivotably mounted roller levers. The limitation of the axial play of the cam roller is provided by side walls of a housing of the cam follower, by virtue of the side walls having run-on surfaces for the end surfaces of the cam roller.

Said run-on surfaces are conventionally part of the side walls which are of substantially planar design in the region of the cam roller, wherein an undesirably high degree of sliding friction can occur between the end surfaces of the cam roller and the run-on surfaces depending on the surface quality of said run-on surfaces. Furthermore, in the event that the side walls do not run sufficiently parallel to one another, undefined points of edge contact can occur between the cam roller and run-on surfaces, with corresponding edge wear.

OBJECT OF THE INVENTION

It is therefore an object of the present invention to develop a cam follower of the type specified in the introduction in such a way that a defined and consequently low-friction and/or low-wear axial run-on of the cam roller against the side walls of the housing of the cam follower is ensured.

SUMMARY OF THE INVENTION

Said object is achieved by means of the characterizing features of claim 1, while advantageous refinements and embodiments of the invention can be gathered from the subclaims. Accordingly, it is sought for the run-on surfaces to be punctiform elevations of the side walls. The required defined contact between the cam roller and side walls is given in that the contact surface of an elevation, which serves as an axial stop for the associated end surface of the cam roller, is considerably smaller than the end surface which runs thereon. Here, in the extreme case, this may involve non-areal punctiform contact. In the mostly usual case of the axle-mounted cam roller, it is self-evident that even one punctiform elevation per side wall is sufficient as a run-on surface. It is nevertheless also possible for two or more such elevations to be provided per side wall.

In one refinement of the invention, it is provided that the elevations have the shape of a cylindrical segment with a surface which is arched in the circumferential direction of the cam roller, or the shape of a spherical segment. The cylindrical segment, which is aligned in the circumferential direction of the cam roller, may assist the transport of oil mist into the contact region between the cylindrical segment and the end surface which runs thereon, of the cam roller in the manner of a hydrodynamic plain bearing. The contact friction which is reduced in this way is also obtained to a limited extent in the case of the spherical segment, which, with the benefit of simplified production, requires no orientation with regard to the circumferential direction of the cam roller.

According to one particularly preferred physical embodiment of the invention, it is sought for the cam follower to be a rocker arm or tilting lever, with the elevations being produced by embossing the side walls of the housing which is shaped from sheet-metal material. This also permits simple and cost-effective production of the cam follower. Here, it may be provided that the cam roller is mounted on a journal which is retained in holding bores of the side walls, with the side walls each being provided with two embossed elevations, at both sides of the associated holding bore.

Said levers are known to a person skilled in the art as pivotably mounted transmission elements between a cam and gas exchange valve. These differ from a kinematic aspect by the location of their mounting. In contrast to centrally mounted tilting levers, rocker arms are mounted at their end sections.

BRIEF DESCRIPTION OF THE DRAWINGS

Further features of the invention can be gathered from the following description and from the drawings, which illustrate the invention on the basis of the example of a rocker arm, and in which.

DETAILED DESCRIPTION OF THE DRAWINGS

Figure 1:
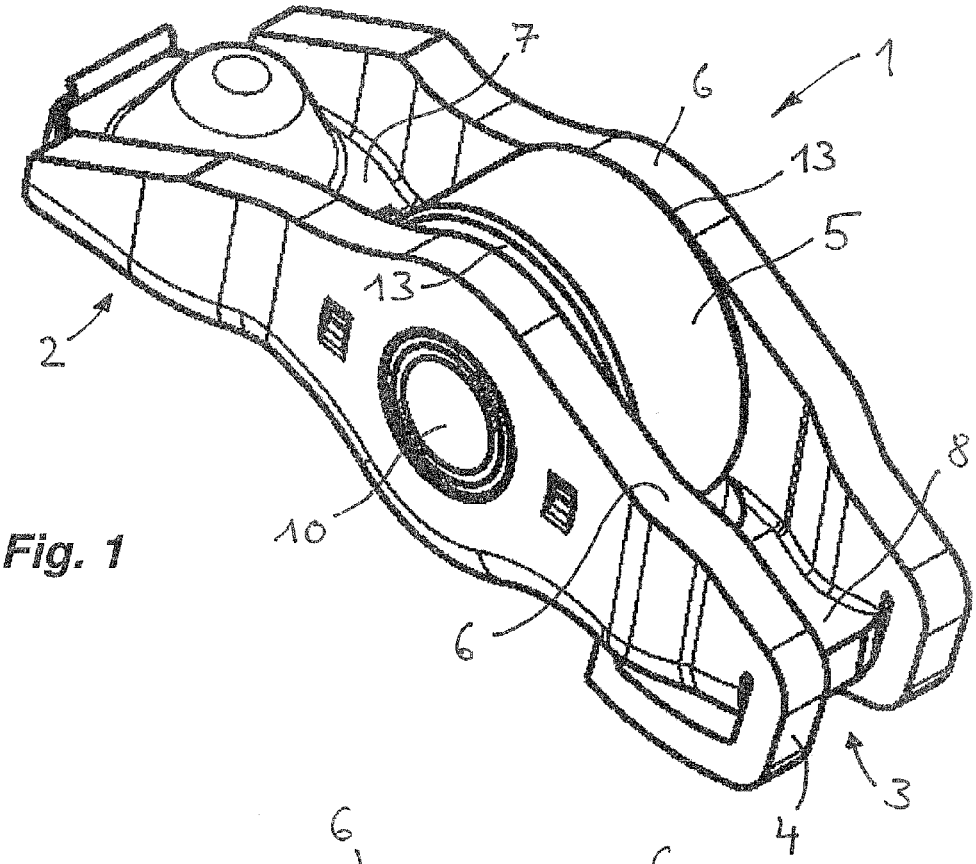
FIG. 1 shows the rocker arm in a perspective plan view.
Figure 4:
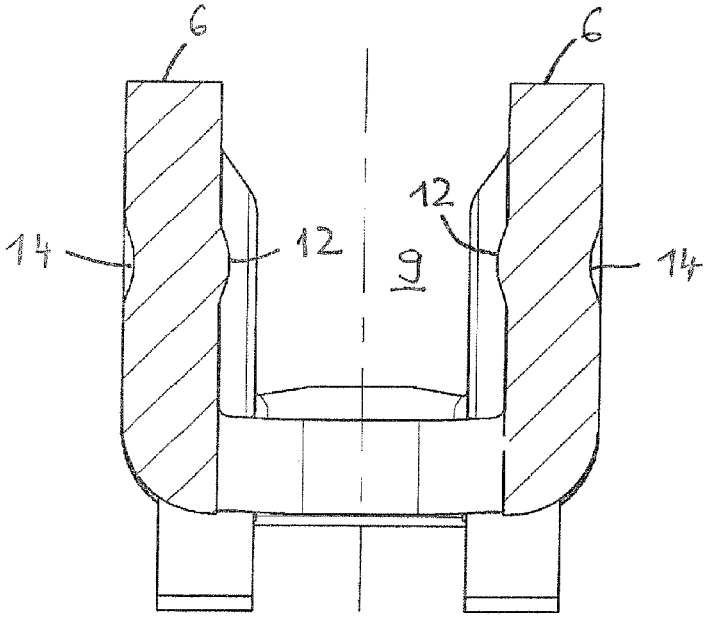
FIG. 4 shows the section I-I as per FIG. 3.

In FIG. 1, a cam follower 1 according to the invention for a valve drive of an internal combustion engine, is disclosed. The cam follower 1 is designed as a rocker arm which, in a known way, is mounted in the manner of a ball joint at its first end section 2 on a support element arranged so as to be stationary in the internal combustion engine, and which, with its second end section 3, actuates a gas exchange valve. The rocker arm 1 has a housing 4 which is produced from a sheet metal material in a cold working process, and a cam roller 5 for the low-friction tapping of a cam of a camshaft. The housing 4 is profiled so as to be U-shaped in cross section with side walls 6 and transverse webs 7 and 8 which connect the side walls 6 at both sides of a roller pocket 9 which holds the cam roller 5 (see FIG. 4), and is open in the direction of the cam. The cam roller 5 is mounted on a journal 10 which bridges the side walls 6 and which is retained, by means of calking of the journal ends, in holding bores 11, which are aligned with one another, in the side walls 6 (see FIG. 2).

Figure 2:
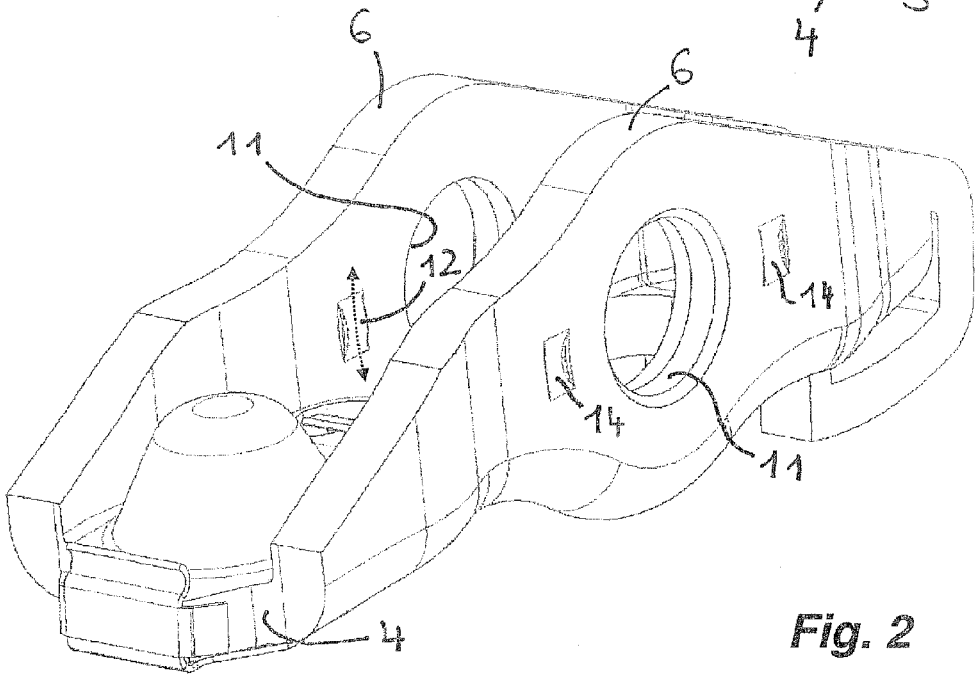
FIG. 2 shows the housing of the rocker arm as per FIG. 1 in a perspective side view.

As can be seen particularly clearly from FIG. 2, the side walls 6 have run-on surfaces 12 for the end surfaces 13 of the cam roller 5. While the run-on surfaces of similar rocker arms conventionally have a high level of roughness on account of a punching process for the final shaping of the roller pocket 9, the run-on surfaces 12 according to the invention are designed as punctiform elevations, and in this exemplary embodiment, are designed as cylindrical segments with a comparatively high surface quality and with a correspondingly low coefficient of friction. As is shown by the arrow in FIG. 2, the cylindrical segments have a surface which is arched in the circumferential direction of the cam roller 5 and which is independent of rotational direction.

The production of the elevations 12 takes place during the cold working process of the housing 4 by embossing the side walls 6 from the outside inward, such that the outer sides of the side walls 6 have corresponding inwardly molded portions 14. This can be seen from the sectioned illustration of FIG. 4. Two elevations 12 are embossed on each side wall 6, which elevations 12 run in the longitudinal direction of the housing 4 at both sides of the associated holding bore 11, and mirror-symmetrically with respect to the latter in the present exemplary embodiment.

Figure 3:
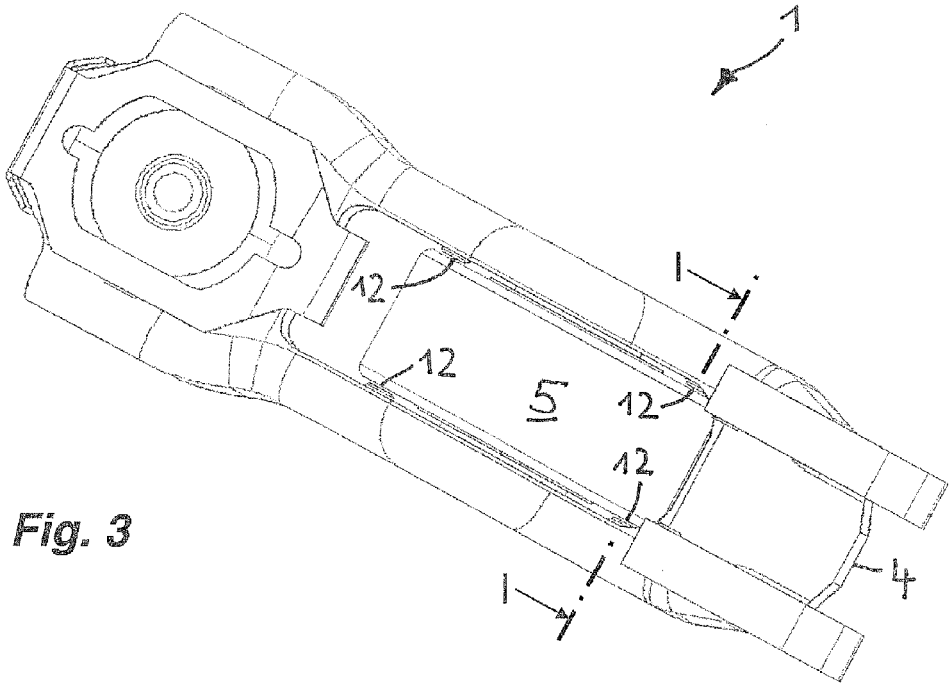
FIG. 3 shows the rocker arm as per FIG. 1 in a view from below.

The view of the rocker arm 1 from below in FIG. 3 shows that the axial play, which is conventionally a few tenths of a millimeter, of the cam roller 5 between the run-on surfaces 12 can advantageously be adjusted by means of the height of the elevations 12. In other words, it is possible for identically dimensioned housings 4 to be fitted with cam rollers 5 of different widths, and, in the process, for the axial play of said cam rollers 5 to be kept constant by means of corresponding heights of the elevations 12.

A further advantage of the run-on surfaces 12 according to the invention relates to the above-mentioned punching process for the shaping of the roller pocket 9, since the cut quality, that is to say the roughness and dimensional accuracy, of said roller pocket is now substantially independent of the run-on surfaces 12, with the benefit of an increased service life of the punching tool.

LIST OF REFERENCE SYMBOLS

1 Cam Follower/Rocker Arm
2 First End Section
3 Second End Section
4 Housing
5 Cam Roller
6 Side Wall
7 Transverse Web
8 Transverse Web
9 Roller Pocket
10 Journal
11 Holding Bore
12 Run-on Surface/Elevation
13 End Surface of the Cam Roller
14 Inwardly Molded Portion

The invention claimed is:

1. A cam follower for a valve drive of an internal combustion engine, comprising:

a housing; and a cam roller which is held at end surfaces of the cam roller, between side walls of the housing, with the side walls having run-on surfaces for the end surfaces of the cam roller, wherein the run-on surfaces are punctiform elevations of the side walls.

2. The cam follower according to claim 1, wherein the punctiform elevations are a cylindrical segment having a surface arched in a circumferential direction of the cam roller, or a shape of a spherical segment.

3. The cam follower according to claim 1, wherein the cam follower is a rocker arm or tilting lever, with the punctiform elevations being produced by embossing the side walls of the housing which is shaped from sheet-metal material.

4. The cam follower according to claim 3, wherein the cam roller is mounted on a journal which is retained in holding bores of the side walls, the side walls each having two punctiform elevations, at both sides of the holding bores.

* * * * *